United States Patent [19]

Tokushima et al.

[11] 4,134,376

[45] Jan. 16, 1979

[54] EXHAUST GAS RECYCLING SYSTEM

[75] Inventors: Takashige Tokushima; Hideki Tanaka, both of Hiroshima, Japan

[73] Assignee: Toyo Kogyo Co., Ltd., Hiroshima, Japan

[21] Appl. No.: 836,903

[22] Filed: Sep. 26, 1977

[30] Foreign Application Priority Data

Oct. 4, 1976 [JP] Japan ..... 51-119665

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 4,040,402 | 8/1977 | Nohira et al. | 123/119 A |
| 4,041,913 | 8/1977 | Nohira et al. | 123/119 A |
| 4,061,119 | 12/1977 | Takeshita et al. | 123/119 A |
| 4,066,056 | 1/1978 | Nohira et al. | 123/119 A |

*Primary Examiner*—Wendell E. Burns

[57] ABSTRACT

An exhaust gas recycling system for use in an internal combustion engine in which downstream exhaust gas recycling is started when the carburetor throttle valve is opened larger than a first predetermined opening degree, while upstream exhaust gas recycling is commenced when the carburetor throttle valve is opened larger than a second predetermined opening degree. The second predetermined opening degree is set at a level exceeding at least a maximum amount or peak value of the downstream exhaust gas recycling, and thereafter, reduction of downstream exhaust gas recycling ratio following decrease of intake negative pressure at the downstream of the carburetor throttle valve is compensated by increase of the upstream exhaust gas recycling augmented in proportion to the intake amount of the air-fuel mixture, through employment of flow rate control valves for the upstream and downstream exhaust gas recycling.

8 Claims, 4 Drawing Figures

EXHAUST GAS RECYCLING SYSTEM

Figure 1:
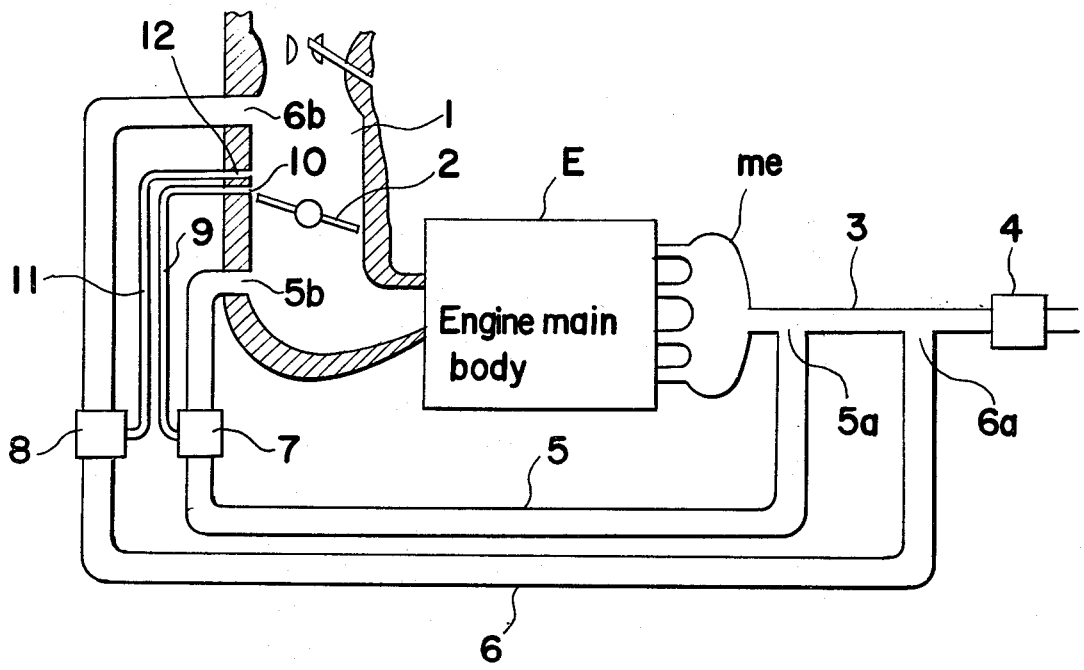

The present invention relates to an exhaust gas recycling system and more particularly, to recycling amount control in an exhaust gas recycling system for an internal combustion engine in which a portion of exhaust gases is recycled to upstream and downstream of a carburetor throttle valve in an air-fuel mixture intake passage of the engine.

From the viewpoint of air pollution control, unburned noxious compounds such as nitrous oxides, carbon monoxide, hydrocarbon, etc., resulting from combustion of an air-fuel mixture in an internal combustion engine should be suppressed or kept to a minimum amount.

In order to achieve the strict standards of the recent air pollution legislation, it is generally accepted as effective to attempt to drastically suppress such unburned noxious compounds, especially nitrogen oxides or $NO_x$ by a large amount of exhaust gases recycled to upstream and downstream of the carburetor throttle valve respectively, while sufficient speed of combustion of the internal combustion engine is maintained by setting air-fuel ratio of the air-fuel mixture to the vicinity of theoretical air-fuel ratio. Such a recycling of exhaust gases as described above is referred to as EGR hereinbelow.

Conventionally, for recycling the exhaust gases simultaneously to the upstream and downstream of the carburetor throttle valve of an internal combustion engine in the manner as described above, there has been proposed an arrangement, for example, in U.S. Pat. No. 3,827,414. The known arrangement, however, has such a disadvantage that from a difference in the EGR characteristics between the upstream exhaust gas recycling and downstream exhaust gas recycling, it is very difficult to maintain a proper EGR ratio $$\left(\frac{\text{Amount of recycled exhaust gas (EGR)}}{\text{Amount of intake air-fuel mixture}} \times 100\right)$$

throughout a wide operational range of the engine, and that especially when the EGR amount becomes excessive, combustibility of the engine is heavily deteriorated, with consequent reduction of the engine output.

Accordingly, an essential object of the present invention is to provide an exhaust gas recycling system for an internal combustion engine which is capable of substantially maintaining exhaust gas recycling (EGR) ratio constant on the whole throughout the engine operational range irrespective of degree of opening of a carburetor throttle valve of the engine so that the formation of the undesirable nitrogen oxides ($NO_x$) is sufficiently suppressed, with simultaneous stabilization of the combustibility of the engine and substantial elimination of disadvantages inherent in conventional exhaust gas recycling arrangements of the kind.

Another important object of the present invention is to provide an exhaust gas recycling system of the above described type which is simple in construction and stable in functioning, and can be readily incorporated into various kinds of internal combustion engines at low cost.

In accomplishing these and other objects, according to the present invention, the exhaust gas recycling system is fundamentally characterized in that the downstream is started when the carburetor throttle valve is opened larger than a first predetermined opening degree, while the upstream EGR is commenced when the carburetor throttle valve is opened larger than a second predetermined opening degree. The second predetermined opening degree referred to above is set at a level exceeding at least a maximum amount or peak value of the downstream EGR, and thereafter, reduction of downstream EGR ratio following decrease of intake negative pressure at the downstream of the carburetor throttle valve is adapted to be compensated by increase of the upstream EGR augmented in proportion to the intake amount of the air-fuel mixture, through employment of flow rate control valves for the upstream and downstream EGR, thus the exhaust gas recycling ratio being maintained constant throughout the engine operational range regardless of the opening degrees of the carburetor throttle valve, with sufficient supression of the $NO_x$ formation and simultaneous stabilization of the engine combustibility.

Figure 2:
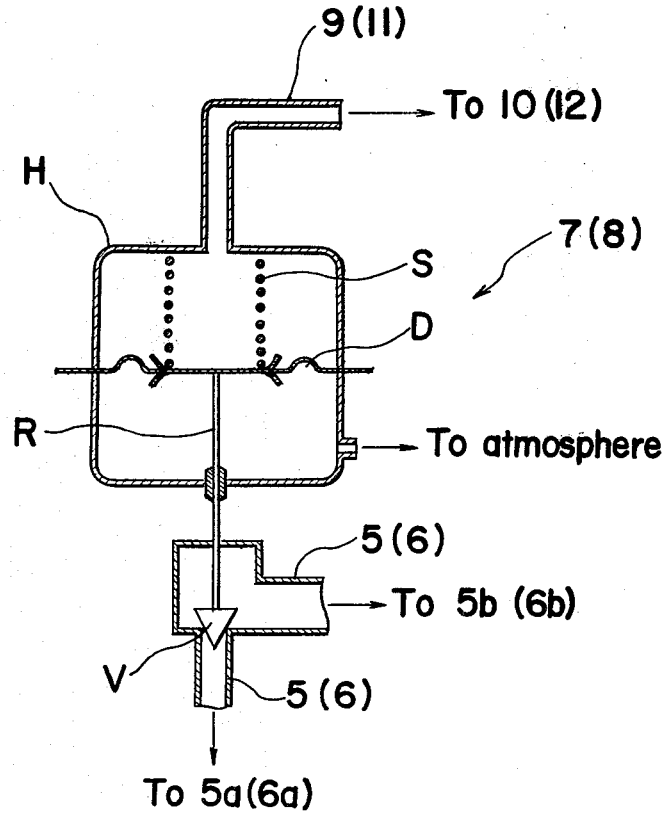
Figure 3:
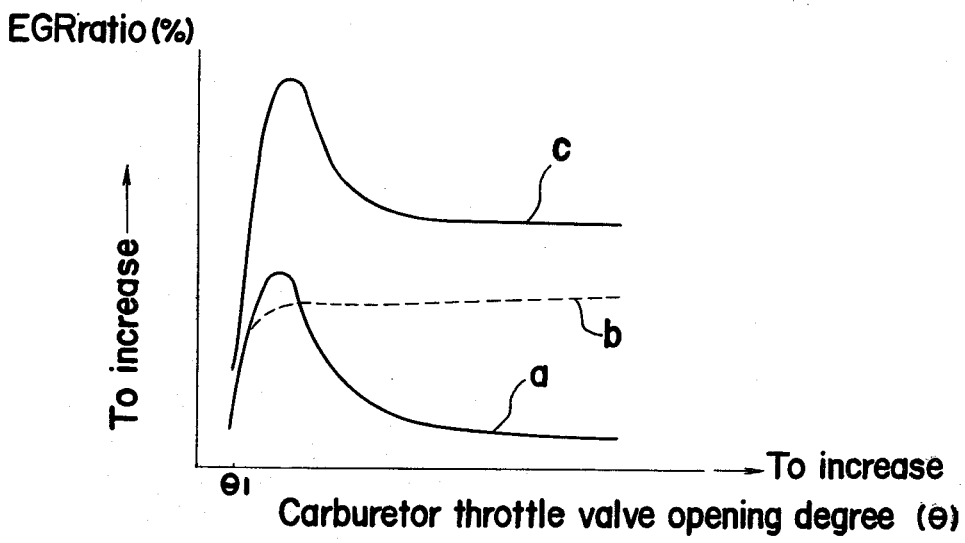
Figure 4:
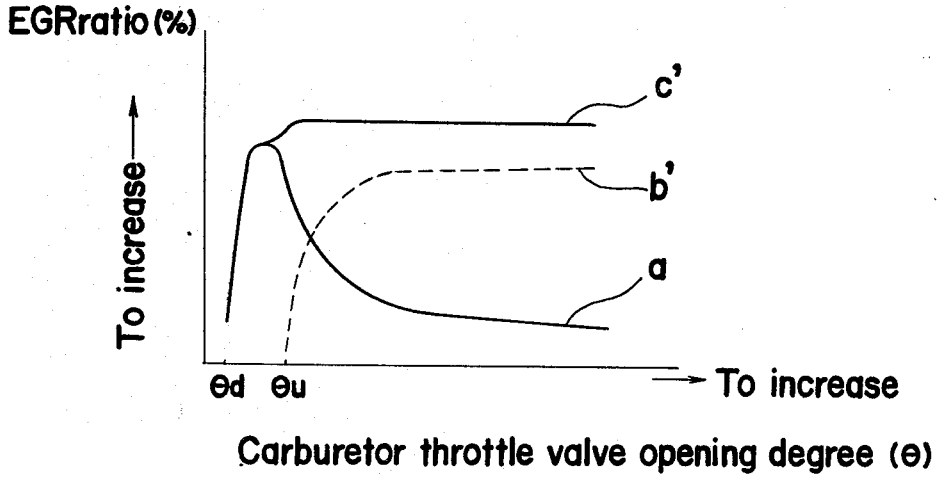

These and other objects and features of the present invention will become apparent from the following description taken in conjunction with the preferred embodiment thereof with reference to the attached drawings, in which;

FIG. 1 is a schematic diagram of an exhaust gas recycling system of the invention incorporated into an internal combustion engine, FIG. 2 is a cross sectional view showing, on an enlarged scale, construction of an EGR flow rate control valve employed in the system of FIG. 1, FIG. 3 is a graph showing relation of overall EGR ratio upon simultaneous starting of the upstream and downstream EGR with respect to the carburetor throttle valve opening degree $\theta$, and FIG. 4 is a graph showing relation of EGR characteristics of the exhaust gas recycling system according to the present invention with respect to the carburetor throttle valve opening degree $\theta$.

Before the description of the present invention proceeds, it is to be noted that like parts are designated by like reference numerals throughout views of the accompanying drawings.

Referring now to the drawings, there is schematically shown in FIG. 1 an exhaust gas recycling system according to the present invention which is incorporated in an internal combustion engine E having, for example, four cylinders (not shown), in which air-fuel mixture introduced into the engine E through a common intake passage 1 provided with a carburetor throttle valve 2 is supplied into the cylinders of the engine E, and after combustion in the cylinders at predetermined ignition sequence, exhaust gases therefrom are discharged in a known manner into atmosphere through an exhaust manifold me, an exhaust gas lead-out pipe 3 connected at one end thereof to the exhaust manifold me, and a catalysis type purification device 4 provided adjacent to the other end of the lead-out pipe 4 which opens into the atmosphere. For constituting the exhaust gas recycling system directly related to the present invention, there is provided a first exhaust gas recycling passage 5 (referred to as a downstream EGR passage hereinbelow) equipped therein with a first exhaust gas recycling flow rate control valve 7 (referred to as a downstream EGR valve hereinbelow) and having at its one end a first exhaust gas deriving port 5*a* opened into the lead-out pipe 3 in a position adjacent to a junction of the lead-out pipe 3 and the exhaust manifold me, and also having at its other end a downstream exhaust gas recycling port 5*b* opened into a downstream of the carburetor throttle valve 2 in the intake passage 1, while there is also disposed a second exhaust gas recycling passage 6 (referred to as an upstream EGR passage hereinbelow) provided therein with a second exhaust gas recycling flow rate control valve 8 (referred to as an upstream EGR valve hereinbelow) and having at its one end a second exhaust gas deriving port 6a opened into the lead-out pipe 3 in a position at a downstream of the first exhaust gas deriving port 5a and also having at its other end an upstream exhaust gas recycling port 6b opened into an upstream of the carburetor throttle valve 2 in the intake passage 1.

The first and second exhaust gas recycling flow rate control valves, i.e., the downstream and upstream EGR valves 7 and 8 may, for example, be diaphragm valves of similar construction as shown in FIG. 2 and actuated by intake negative pressure of the engine E. More specifically, the downstream EGR valve 7, for example, includes a valve housing H connected to one end of a negative pressure conduit 9 mentioned later, a diaphragm D housed in the housing H and secured at its outer periphery to walls of the housing H, a spring S disposed in the housing H so as to urge the diaphragm D in one direction, and a valve rod R secured at its one end to the diaphragm D and slidably extending through the housing H into the downstream EGR passage 5 for selectively opening and closing the passage 5 by a valve V secured at the other end of the rod R as shown.

The negative pressure conduit 9 for introducing the negative pressure into the downstream EGR valve 7 has at the other end thereof a first negative pressure deriving port 10 opened into the intake passage 1 and located at an upstream of the carburetor throttle valve 2 when the throttle valve 2 is totally or completely closed and at a downstream of the same throttle valve 2 when the throttle valve 2 is opened to a degree larger than a first predetermined opening degree. More specifically, when the throttle valve 2 opens to the degree larger than the first predetermined opening degree, the diaphragm D of the downstream EGR valve 7 is moved by the negative pressure from the negative pressure conduit 9 in a direction against the urging force of the spring S so as to open the downstream EGR passage 5 at the valve V. Similarly, the housing H of the upstream EGR valve 8 having the same construction as that of the downstream EGR valve 7 is coupled to one end of another negative pressure conduit 11 for introducing the negative pressure into the upstream EGR valve 8, while the negative pressure conduit 11 has at its other end a second negative pressure deriving port 12 opened into the intake passage 1 and positioned at an upstream of the first negative pressure deriving port 10 so as to be located at the downstream of the carburetor throttle valve 2 when the throttle valve 2 is opened to a degree larger than a second predetermined opening degree. Accordingly, when the throttle valve 2 is opened to the degree exceeding the second predetermined opening degree, the upstream EGR passage 6 is opened at the valve 7 of the EGR valve 8 by the negative pressure from the negative pressure conduit 11 in the similar manner as in the upstream EGR valve 7.

As is seen from the foregoing description, by arranging to start the downstream EGR through actuation of the downstream EGR valve 7 by the intake negative pressure derived from the first negative pressure deriving port 10 which is located at the downstream of the carburetor throttle valve 2 when the throttle valve 2 is opened to the first predetermined opening degree, and thereafter to start the upstream EGR in addition to the downstream EGR through actuation of the upstream EGR valve 8 by the intake negative pressure derived from the second negative pressure deriving port 12 which is located at the downstream of the carburetor throttle valve 2 when the throttle valve 2 is opened to the second predetermined opening degree, it is possible to avoid adding the upstream EGR with respect to the EGR ratio given by the downstream EGR during the time through which the carburetor throttle valve 2 reaches the second predetermined opening degree.

Referring also to FIGS. 3 and 4, more specifically, it is known that there is a general relation as shown in FIG. 3 between the degree of opening $\theta$ of the carburetor throttle valve and the upstream and downstream EGR ratios. In other words, as is seen from FIG. 3, on the assumption that the upstream and downstream EGR valves 7 and 8 are started to be opened at a given opening degree $\theta_1$ of the carburetor throttle valve 2, the downstream EGR ratio represented by a curve a shows a sharp peak value immediately after the opening of the EGR valve by a strong intake negative pressure and thereafter gradually falls as the opening degree $\theta$ of the throttle valve 2 increases. Meanwhile, the upstream EGR ratio represented by a dotted curve b is approximately constant irrespective of the throttle valve opening degree $\theta$ since the EGR amount is proportional to the intake amount of the air-fuel mixture. Therefore, when the upstream and downstream EGR valves 7 and 8 are simultaneously subjected to opening, an overall EGR ratio in the combination of the upstream and downstream EGR represented by a curve c tends to have a large peak value at a stage where the throttle valve opening degree $\theta$ is small as is noticed from FIG. 3. Incidentally, since the exhaust gas recycling amount should desirably be at a predetermined constant rate with respect to the amount of intake air-fuel mixture, it is preferable that the overall EGR ratio in the combination of the upstream and downstream EGR is constant.

Accordingly, in the exhaust gas recycling system of the present invention, the upstream EGR is so arranged as to be started to avoid the peak value of the downstream EGR ratio. More specifically, as shown in FIG. 4, in the arrangement of the present invention, the downstream EGR represented by a curve a is started when the opening degree $\theta$ of the throttle valve 2 has reached the first predetermined opening degree $\theta_d$, while the upstream EGR represented by a curve b' is started when opening degree $\theta$ of the throttle valve 2 has reached the second predetermined opening degree $\theta_u$ set at a position beyond the peak value of the line a. By the above arrangement, the overall EGR ratio represented by a line c' approximately coincides with the downstream EGR ratio of the curve a between the first predetermined opening degree $\theta_d$ and the second predetermined opening degree $\theta_u$, and, in the period beyond the peak value of the downstream EGR ratio of the curve a, coincides with the sum of the downstream EGR ratio of the curve a gradually decreasing thereafter and the upstream EGR ratio of the curve b' which rises from the second predetermined opening degree $\theta_u$, and thereafter takes an approximately constant value. In the above case, the decrease of the downstream EGR ratio of the curve a is supplemented by the increase of the upstream EGR ratio of the curve b', and thus it is possible to make the overall EGR ratio represented by the curve c' approximately constant at least at the throttle valve opening degree larger than the second predetermined opening degree $\theta_u$.

It should be noted here that the upstream and downstream EGR valves or flow rate control valves 7 and 8 described as actuated by the intake negative pressure in the foregoing embodiment may be so modified, for example, as to be actuated by electrical signals obtained by electrical detection of the opening degrees of the throttle valve 2.

It should also be noted that although the upstream and downstream EGR valves 7 and 8 are described as actuated by the intake negative pressure obtained from different deriving ports 10 and 12, the arrangement may be so modified, for example, that the EGR is effected step by step by applying the intake negative pressure derived from one single deriving position (not shown) to the downstream EGR valve 7 when the throttle valve opening degree has reached the first predetermined opening degree, and subsequently to the upstream EGR valve 8 when the throttle valve opening degree has reached the second predetermined opening degree, and that the upstream and downstream EGR valves may be replaced by solenoid valves or the like as stated earlier to electrically detect the throttle valve opening degrees for effecting the EGR in the stepped manner.

As is clear from the foregoing description, according to the arrangement of the present invention, the first flow rate control valve or downstream EGR valve 7 provided in the course of the first exhaust gas recycling passage 5 for recycling the exhaust gases to the intake passage 1 at the downstream of the carburetor throttle valve 2 is adapted to be opened at the first predetermined opening degree of the throttle valve 2, while the second flow rate control valve or upstream EGR valve 8 provided in the course of the second exhaust gas recycling passage 6 for recycling the exhaust gases to the intake passage 1 at the upstream of the carburetor throttle valve 2 is arranged to be opened at the second predetermined opening degree of the throttle valve larger than the first predetermined opening degree, by which arrangement, it has been made possible to drastically suppress the undesirable $NO_x$, with the overall EGR being made approximately constant without any appreciable variation.

Moreover, when the first and second negative pressure deriving ports are so arranged as to be subjected to the negative pressure when the carburetor throttle valve has been opened to a degree larger than the first and second predetermined opening degrees for actuation of the first and second flow rate control valves by the respective pressure, the exhaust gas recycling system according to the present invention may be readily put into actual use through an extremely simple construction.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. An exhaust gas recycling system for use in an internal combustion engine which comprises a first exhaust gas recycling passage for recycling part of exhaust gases to intake passage at downstream of a carburetor throttle valve, a second exhaust gas recycling passage for recycling part of the exhaust gases to the intake passage at upstream of the carburetor throttle valve, and first and second exhaust gas recycling flow rate control valves respectively provided in said first and second exhaust gas recycling passages, said first exhaust gas recycling flow rate control valve being arranged to be opened when said carburetor throttle valve is opened to a degree larger than a first predetermined opening degree thereof, with said second exhaust gas recycling flow rate control valve being arranged to be opened when said carburetor throttle valve is opened to a degree larger than a second predetermined opening degree thereof which is larger than said first predetermined opening degree.

2. An exhaust gas recycling system as claimed in claim 1, further comprising a first negative pressure deriving port which is located in said intake passage at the upstream of the carburetor throttle valve when said carburetor throttle valve is completely closed and which is located at the downstream of said carburetor throttle valve when said carburetor throttle valve is opened to a degree larger than said first predetermined opening degree, and a second negative pressure deriving port which is disposed at upstream of said first negative pressure deriving port and which is located at the downstream of said carburetor throttle valve when said carburetor throttle valve is opened to a degree larger than said second predetermined opening degree, said first and second exhaust gas recycling flow rate control valves being arranged to be opened when negative pressure is applied into said first and second negative pressure deriving ports respectively.

3. An exhaust gas recycling system as claimed in claim 2, wherein said first and second exhaust gas recycling flow rate control valves are coupled to said first and second negative pressure deriving ports through corresponding first and second negative pressure conduits respectively for being actuated by said negative pressure.

4. An exhaust gas recycling system as claimed in claim 1, wherein said first and second exhaust gas recycling flow rate control valves are arranged to be actuated by electrical signals obtained through electrical detection of the opening degrees of said carburetor throttle valve.

5. An exhaust gas recycling system as claimed in claim 1, further comprising one negative pressure deriving port which is located in said intake passage in a position adjacent to said carburetor throttle valve so as to apply negative pressure to said first exhaust gas recycling flow rate control valve when said carburetor throttle valve has reached said first predetermined opening degree and to subsequently apply the negative pressure to said second exhaust gas recycling flow rate control valve when said carburetor throttle valve has reached said second predetermined opening degree for effecting the exhaust gas recycling in stepped manner.

6. An exhaust gas recycling system as claimed in claim 5, wherein said first and second exhaust gas recycling flow rate control valves are solenoid valves actuated by electrical signals obtained through electrical detection of the opening degrees of said carburetor throttle valve.

7. In an exhaust gas recycling system for use in an internal combustion engine which includes a first exhaust gas recycling passage for recycling part of exhaust gases to intake passage at downstream of a carburetor throttle valve, a second exhaust gas recycling passage for recycling part of the exhaust gases to the intake passage at upstream of the carburetor throttle valve, and first and second exhaust gas recycling flow rate control valves respectively provided in said first and second exhaust gas recycling passages, a method of recycling exhaust gases which comprises the steps of opening said first exhaust gas recycling flow rate control valve when said carburetor throttle valve is opened to a degree larger than a first predetermined opening degree thereof, and opening said second exhaust gas recycling flow rate control valve when said carburetor throttle valve is opened to a degree larger than a second predetermined opening degree thereof which is larger than said first predetermined opening degree.

8. An exhaust gas recycling system as claimed in claim 1, wherein the second predetermined opening degree is set at a level exceeding at least a peak value of the downstream exhaust gas recycling.

* * * * *